US011536082B2

(12) United States Patent
Hamilton et al.

(10) Patent No.: US 11,536,082 B2
(45) Date of Patent: Dec. 27, 2022

(54) PIVOT BAR FOR SASH WINDOWS

(71) Applicant: JELD-WEN, Inc., Charlotte, NC (US)

(72) Inventors: Rudy Hamilton, Klamath Falls, OR (US); Craig Abbott, Klamath Falls, OR (US); Lou Levison, Klamath Falls, OR (US)

(73) Assignee: JELD-WEN, INC., Charlotte, NC (US)

( * ) Notice: Subject to any disclaimer, the term of this patent is extended or adjusted under 35 U.S.C. 154(b) by 173 days.

(21) Appl. No.: 17/025,666

(22) Filed: Sep. 18, 2020

(65) Prior Publication Data

US 2022/0090435 A1 Mar. 24, 2022

(51) Int. Cl.

| | |
|---|---|
| ***E06B 3/50*** | (2006.01) |
| ***E05D 15/22*** | (2006.01) |
| ***E05C 1/10*** | (2006.01) |

(52) U.S. Cl.

CPC ..... *E06B 3/5063* (2013.01); *E05C 1/10* (2013.01); *E05D 15/22* (2013.01); *E06B 3/5081* (2013.01)

(58) Field of Classification Search

CPC .... E06B 3/5063; E06B 3/5054; E06B 3/5072; E05C 1/10; E05D 15/22

See application file for complete search history.

(56) References Cited

U.S. PATENT DOCUMENTS

| | | | | | |
|---|---|---|---|---|---|
| 3,080,622 | A * | 3/1963 | Mendelsohn | E06B 3/2605 | 292/145 |
| 4,763,445 | A * | 8/1988 | Silverman | E05D 15/22 | 49/176 |
| D319,576 | S * | 9/1991 | Westphal | D8/400 | |
| 5,069,001 | A | 12/1991 | Makarowski | | |
| 5,237,775 | A * | 8/1993 | Hardy | E05D 15/22 | 49/181 |
| 5,669,180 | A * | 9/1997 | Maier | E05D 13/08 | 49/176 |
| 5,802,767 | A * | 9/1998 | Slocomb | E06B 3/9608 | 49/176 |
| 5,927,013 | A * | 7/1999 | Slocomb | E05D 15/22 | 49/176 |
| 6,058,653 | A * | 5/2000 | Slocomb | E05D 15/22 | 49/176 |
| 7,210,267 | B2 * | 5/2007 | VerSteeg | E05D 7/1044 | 49/446 |
| 7,431,355 | B2 * | 10/2008 | Eenigenburg | E05C 1/10 | 292/DIG. 47 |

(Continued)

FOREIGN PATENT DOCUMENTS

| | | | | |
|---|---|---|---|---|
| CA | 2337931 A1 * | 8/2001 | E05D 13/08 | |
| GB | 2109043 A * | 5/1983 | E06B 3/44 | |

OTHER PUBLICATIONS

Jeld-Wen, Inc., "Siteline Clad Double Hung Windows Replacement Parts Catalog," Catalog, Apr. 2018, 23 pages.

*Primary Examiner* — Marcus Menezes

(74) *Attorney, Agent, or Firm* — Lorenz & Kopf, LLP

(57) ABSTRACT

The disclosure relates to a pivot bar for a tiltable sash window where the pivot bar is designed for mounting along an exterior surface of a sash frame. The pivot bar includes a first leg positioned within a channel formed on the stile of the sash frame and a second leg positioned within a channel formed on the bottom rail of the sash frame. In a coupled configuration, the pivot bar wraps around the exterior surface of the corner of the sash frame where the stiles and bottom rail meet.

16 Claims, 6 Drawing Sheets

(56) References Cited

U.S. PATENT DOCUMENTS

| | | | | |
|---|---|---|---|---|
| 9,097,061 | B1 * | 8/2015 | Lawrence | E05D 15/00 |
| 9,611,688 | B1 * | 4/2017 | Vanderbent, Jr. | E06B 3/9641 |
| 11,193,318 | B2 * | 12/2021 | Kellum | E05D 13/04 |
| 2003/0121207 | A1 | 7/2003 | O'Donnell et al. | |
| 2008/0178425 | A1 * | 7/2008 | Tuller | E05D 13/1276 16/197 |
| 2016/0123048 | A1 * | 5/2016 | Sofianek | E05C 1/10 49/183 |

* cited by examiner

PIVOT BAR FOR SASH WINDOWS

TECHNICAL FIELD

The field of the present disclosure relates generally to sash windows, and particularly to a pivot bar design for facilitating the assembly process and improving overall structural integrity for a tiltable sash.

BACKGROUND

Sash window assemblies are well-known in the field. In a conventional configuration, a double-hung sash window includes a pair of sashes slidably supported along parallel planes within a frame. The sashes are mounted for slidable movement along adjacent parallel guide rails within the frame, although in some designs the upper sash may be fixed in position while only the lower sash is movable along a guide rail. Some double-hung sash windows may also incorporate pivot bars or other mechanisms to allow the sashes to tilt inwardly relative to the frame to facilitate cleaning and maintenance of the sash as needed.

In some conventional designs, pivot bars for accommodating the tilting action of the sash are designed to embed into and anchor within the stiles of the sash frame. In these designs, an opening is created along the side of the stiles and a portion of the pivot bar is inserted therethrough. A disadvantage of this design is that drilling into the sash frame and/or improperly aligning the pivot bar within the opening may result in warping or other issues that may impact the longevity and performance of the window. Accordingly, the present inventors have identified a need for an improved pivot bar designed to be surface mounted to avoid penetration into the sash frame. In addition, the present inventors have identified a need for a pivot bar designed to provide improved structural support for the sash frame. Additional aspects and advantages will be apparent from the following detailed description of example embodiments, which proceeds with reference to the accompanying drawings.

DETAILED DESCRIPTION OF EXAMPLE EMBODIMENTS

With reference to the drawings, this section describes embodiments of a pivot bar for tiltable double-hung sash windows or other suitable fenestration systems. Throughout the specification, reference to "one embodiment," "an embodiment," or "some embodiments" means that a described feature, structure, or characteristic may be included in at least one embodiment of the systems and methods described herein. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Figure 1:
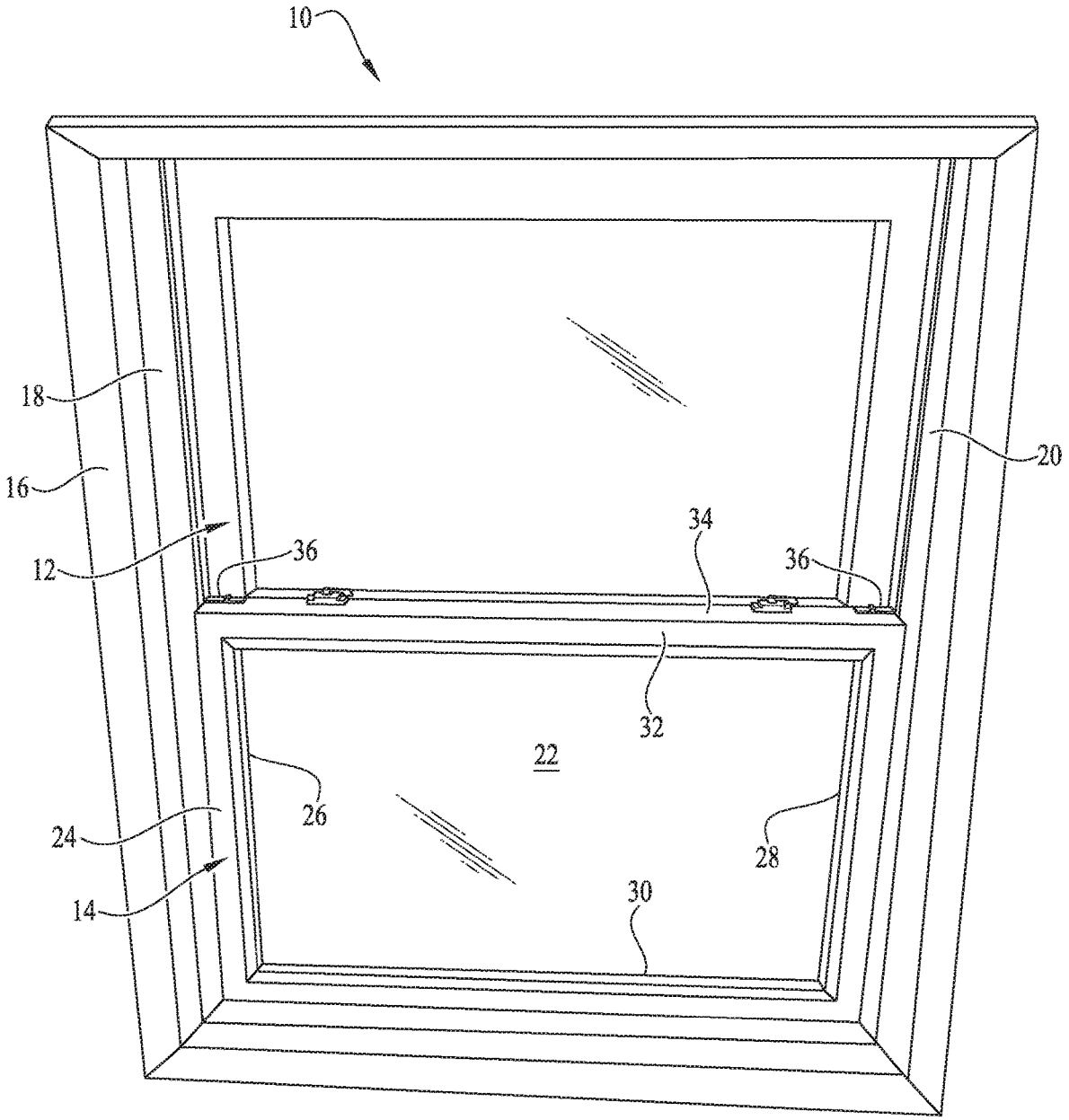
FIG. 1 illustrates a tiltable double-hung sash window in accordance with one embodiment.
Figure 2:
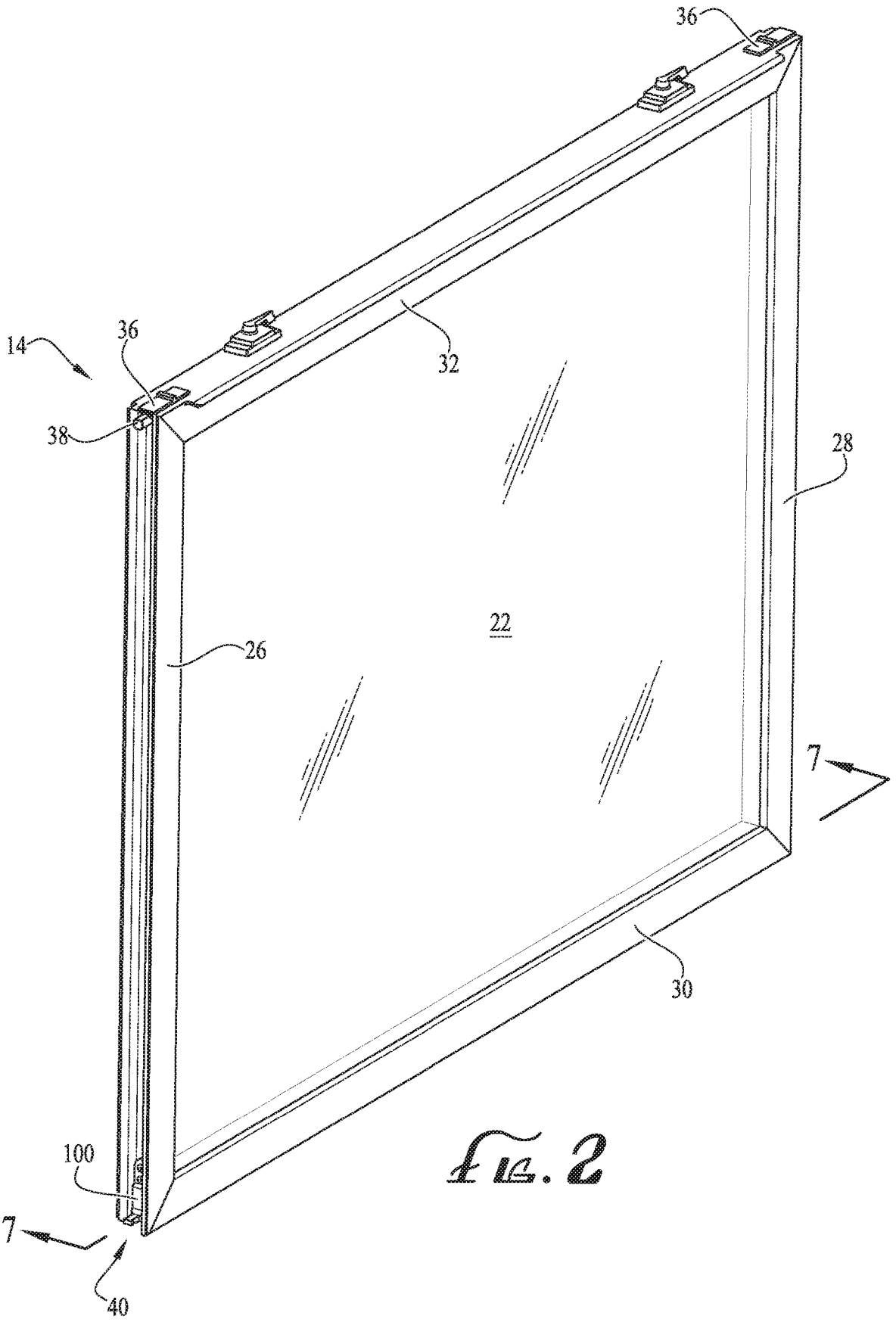
FIG. 2 is a perspective view of a lower sash frame of the window of FIG. 1 illustrating a pivot bar coupled to the sash frame within channels formed along the stiles and the bottom rail in accordance with one embodiment.
Figure 3:
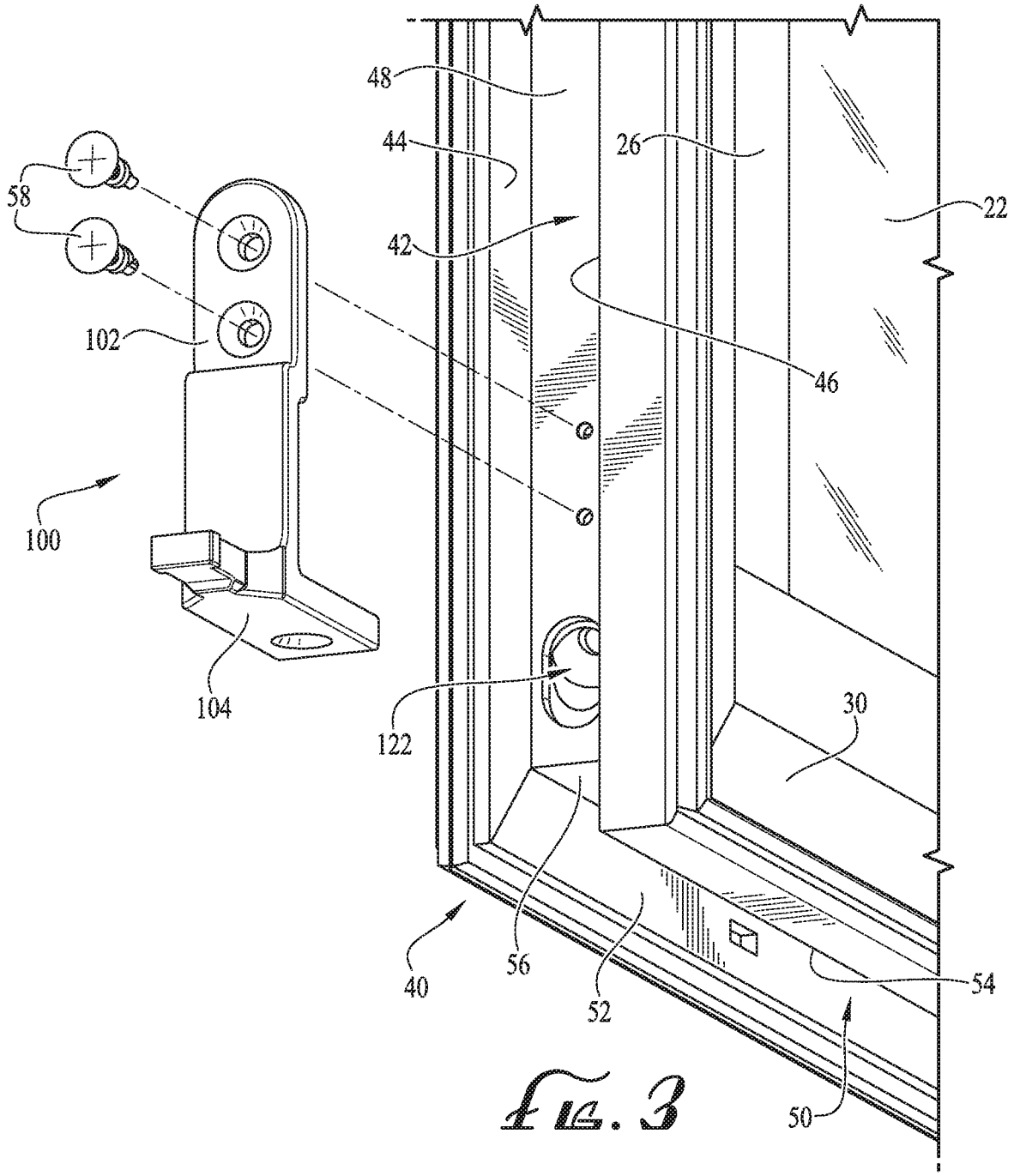
FIG. 3 is an enlarged, partially exploded view of a corner joint of the sash frame of FIG. 2 illustrating features of the pivot bar and its coupling point along the corner joint of the sash frame.

FIGS. 1-8 collectively illustrate embodiments of a pivot bar 100 for use with a tiltable double-hung sash window 10 or other suitable fenestration systems. With general reference to the figures, the pivot bar 100 has an inverted, generally T-shaped profile with a vertical leg 102 and a horizontal leg 104 arranged generally perpendicular relative to one another. The pivot bar 100 further includes a proximal leg 106 generally aligned with the horizontal leg 104 and orthogonal to the vertical leg 102, the proximal leg 106 designed to couple with a balance shoe assembly (not shown) of the window 10 to support the tilting action of the sash window 10. To install the pivot bar 100 to the sash frame 24, the vertical leg 102 of the pivot bar 100 is mounted along the stile 26 within its channel 42, and the horizontal leg 104 of the pivot bar 100 is mounted along the bottom rail 30 within its corresponding channel 50 as best illustrated in FIG. 3. It is noted that a second pivot bar (not shown) is also mounted to the opposite stile 28 and the bottom rail 30 of the sash frame 24 in a substantially similar configuration to support the tilting action of the sash window 10 along both corners.

Figure 7:
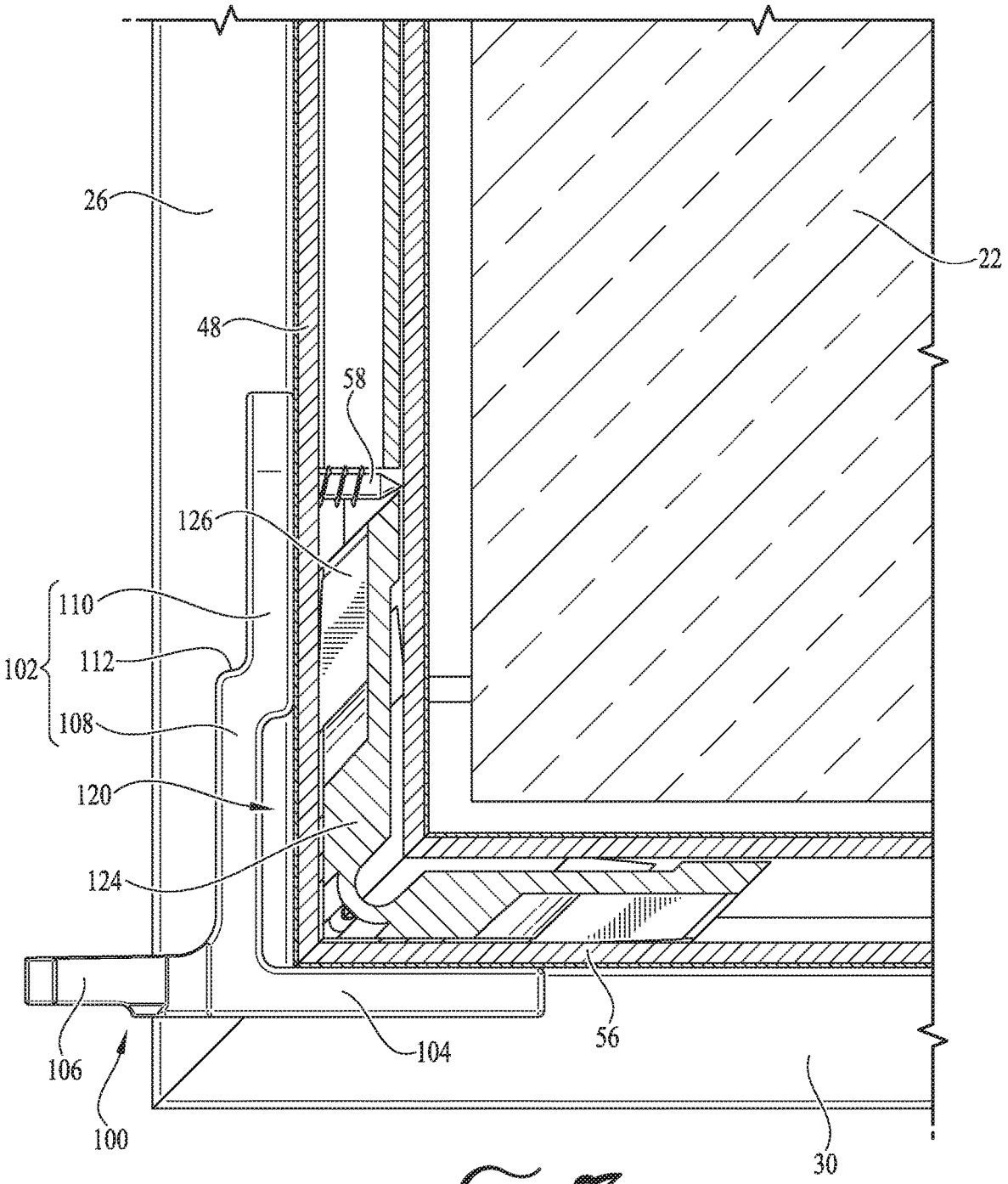
FIG. 7 is a cross-section view of the sash frame along sectioning lines 7-7 of FIG. 2 illustrating an example assembly of the pivot bar coupled along the corner joint of the sash frame.
Figure 8:
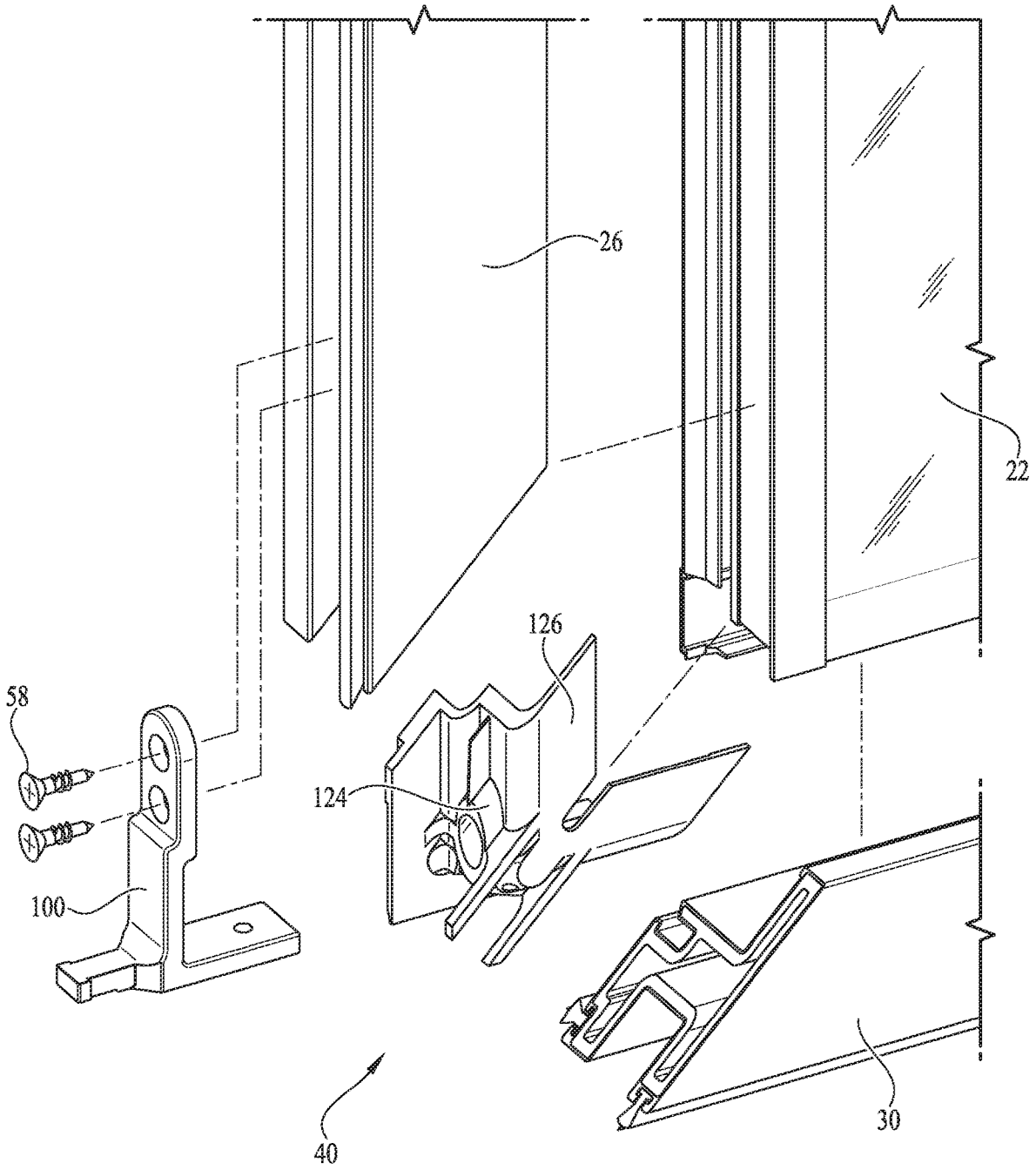
FIG. 8 is a partially exploded view of the sash frame of FIG. 2 illustrating a corner key and the pivot bar in accordance with one embodiment.

With collective reference to FIGS. 3, 7 and 8, when the pivot bar 100 is coupled to the stile 26 and bottom rail 30, a pocket 120 is formed between a first leg segment 108 of the vertical leg 102 and the stile 26. The pocket 120 communicates with an opening 122 formed on the stile 26 (see FIG. 3), which in turn communicates with a port 124 of a corner key 126 used to reinforce the corner joint 40. The pocket 120 is designed to capture any excess sealant or resin material exiting the port 124 of the corner key 126 during the frame joining and assembly process.

As described in further detail below, the pivot bar 100 is designed to be surface mounted directly onto the stiles 26, 28 and the bottom rail 30 of the sash frame 24 to expedite the assembly process of the window 10 and avoid unnecessary machining and/or insertion of the pivot bar directly into the sash frame 24. In addition, designing the pivot bar 100 such that it wraps around the corner joint 40 of the sash frame 24 provides additional structural support for the overall assembly to improve the longevity of the window 10. Additional details of these components and embodiments of the pivot bar 100 are provided below with reference to the figures.

FIG. 1 illustrates an example embodiment of a vertical lift double-hung sash window 10 including a top sash 12 and a bottom sash 14 slidably mounted in a window frame 16. The window frame 16 includes opposing left and right jambs 18, 20 along which one or both sashes 12, 14 slides vertically to open and close the window 10 as desired. In some embodiments, the top sash 12 may be fixed in position and only the bottom sash 14 may move upwardly and downwardly within the frame 16. Bottom sash 14 includes glazing 22 (which may include a single pane of glass, an insulated double-pane glazing unit, or any suitable multi-pane glazing unit) supported within a sash frame 24 between vertically elongate left and right stiles 26, 28. The sash frame 24 includes a bottom rail 30 and a top rail 32 extending horizontally between the stiles 26, 28 on opposite sides of glazing 22. The top sash 12 includes the same glazing and sash frame configuration, but further details of the top sash 12 are not further discussed for simplicity and to avoid repetition.

The bottom sash 14 supports a pair of tilt latch mechanisms 36 mounted along a top surface 34 of the top rail 32, and a pair of pivot bars 100 mounted to the stiles 26, 28 and the bottom rail 30 (FIG. 2 illustrates one such pivot bar 100). Briefly, the latch mechanisms 36 each include pins or other suitable members 38 that extend horizontally outward in an opposing direction to engage a corresponding jamb 18, 20. In operation, the latch mechanisms 36 are selectively actuated to disengage the pins 38 from the jambs 18, 20 and allow the bottom sash 14 to pivot about the pivot bars 100 for facilitating cleaning and repair as noted previously. With general reference to FIGS. 2-8, the following discussion focuses on specific details of the pivot bars 100 and their functionality for supporting the tilting action of the bottom sash 14 of the window 10.

FIG. 2 is a view of the bottom sash 14 and illustrates the pivot bar 100 mounted to the stile 26 and the bottom rail 30 along a corner joint 40 of the bottom sash 14. FIG. 3 is an enlarged, partially exploded view of the corner joint 40 with the pivot bar 100 illustrated in an uncoupled configuration. It is noted that the bottom sash 14 further includes a second pivot bar (not shown) on the opposite corner where the stile 28 and the bottom rail 30 meet. Details relating to that second pivot bar are not further discussed herein to avoid repetition, but it should be understood that the same description relating to the pivot bar 100 applies equally to the second pivot bar. With collective reference to FIGS. 2-3, the following discusses features of the sash frame 14 designed for receiving the pivot bar 100.

With reference to FIGS. 2-3, the stile 26 (and stile 28) includes a channel 42 formed between a first stile wall 44, a second stile wall 46, and a bottom stile wall 48. As illustrated, the channel 42 may be generally U-shaped (as bounded by the three walls 44, 46, 48) and extend along the entirety of the stile 26 from the bottom rail 30 to the top rail 32, with the opening of the channel 42 facing the jamb 18 when the bottom sash 14 is coupled to the window frame 16. In other embodiments, the channel 42 may only extend partway along the stile 26 as desired. Similarly, the bottom rail 30 includes a channel 50 formed between a first rail wall 52, a second rail wall 54, and a bottom rail wall 56. As illustrated, channel 50 may also be generally U-shaped and extend along the entirety of the bottom rail 30 between the stiles 26, 28 with the opening of the channel 50 facing the bottom of the window frame 16 when the bottom sash 14 is coupled to the window frame 16. In other embodiments, the channel 50 may only extend partway along the rail 30 as desired. As illustrated in FIG. 3, the channels 42, 50 overlap with one another at the corner joint 40 formed between the stile 26 and the rail 30, such that the channels 42, 50 are in communication with each other.

When the pivot bar 100 is coupled to the bottom sash 14, the pivot bar 100 is mounted to the surfaces of the bottom stile wall 48 and the bottom rail wall 56 within the respective channels 42, 50. In this configuration, the pivot bar 100 is mounted entirely to the exterior surface of the bottom sash 14, with no portion of the pivot bar 100 extending into the sash frame 24 itself or otherwise breaking the exterior surface thereof. Rather, in a coupled configuration, the vertical leg 102 of the pivot bar 100 is mounted to the bottom stile wall 48 within the channel 42, and the horizontal leg 104 is mounted to the bottom rail wall 56 within the channel 50. Preferably, the width of the channels 42, 50 is substantially equal to the corresponding widths of the legs 102, 104 of the pivot bar 100 such that the pivot bar 100 sits securely within the channels 42, 50, with the side edges of the leg 102 abutting against the respective stile walls 44, 46 and the side edges of the leg 104 abutting against the respective rail walls 52, 54. To complete the installation, fasteners 58 are used to couple the pivot bar 100 to the sash frame 24 along the respective stiles 26, 28 and the bottom rail 30.

Figure 4:
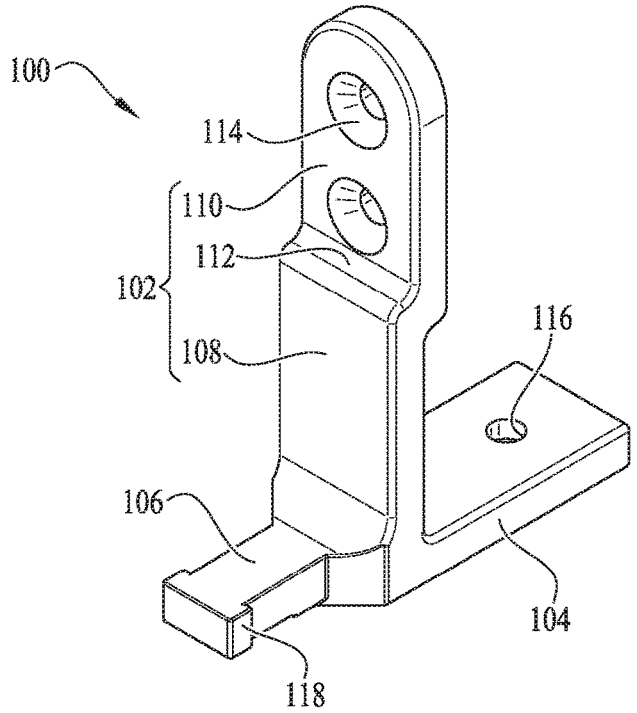
FIGS. 4-6 are various views collectively illustrating the design and features of the pivot bar of FIG. 3.
Figure 5:
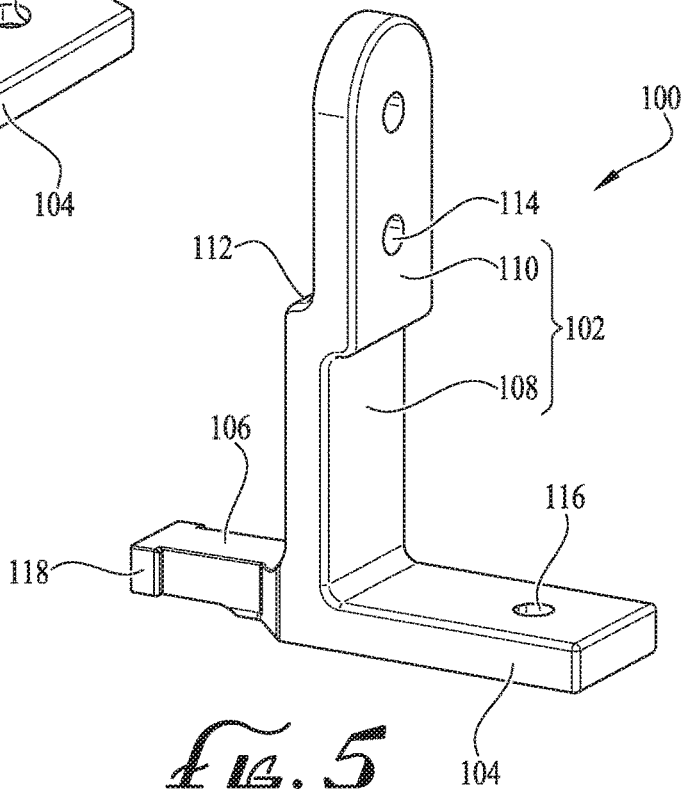
Figure 6:
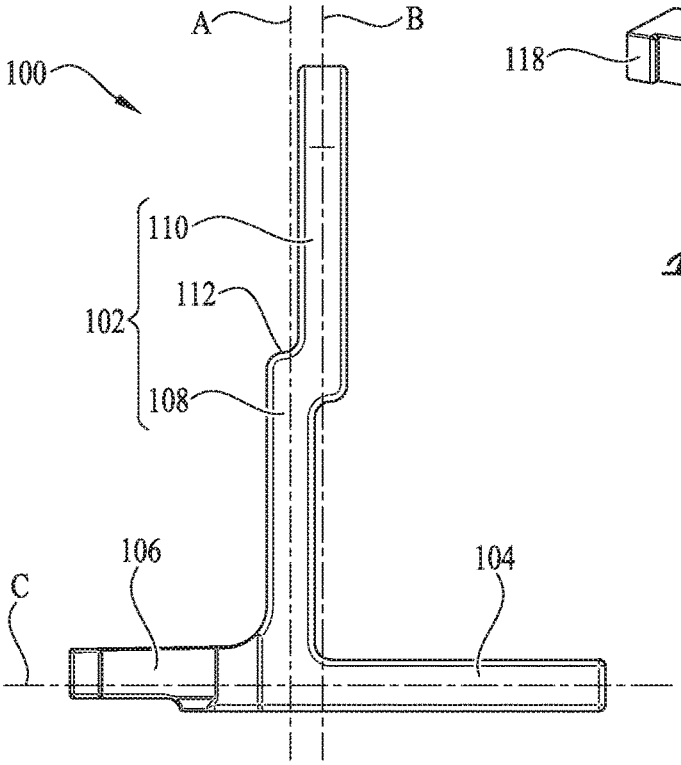

FIGS. 4-6 collectively illustrate various features of the pivot bar 100 in accordance with one embodiment. With reference to the figures, the following section discusses features of the pivot bar 100 itself, followed by a detailed discussion relating to certain characteristics of the pivot bar 100 when coupled to the sash frame 24 with reference to FIGS. 7-8.

With collective reference to FIGS. 4-6, the pivot bar 100 includes an inverted, generally T-shaped profile with a vertical leg 102, a horizontal leg 104, and a proximal leg 106 arranged as noted previously. As best illustrated in FIG. 6, the vertical leg 102 includes a first leg segment 108, a second leg segment 110, and a transition segment 112 connecting the leg segments 108, 110. In one embodiment, the leg segments 108, 110 are arranged along adjacent parallel planes to create a generally stepped profile for the vertical leg 102, with the first leg segment 108 extending substantially linearly along a plane A and the second leg segment 110 extending substantially linearly along an offset and parallel plane B. In this configuration, both leg segments 108, 110 are arranged orthogonally relative to the horizontal leg 104, which extends along a plane C, with the first leg segment 108 being directly connected to the horizontal leg 104 as illustrated. As illustrated in FIG. 6, planes A and B each intersect plane C at approximately 90 degree angles at different intersection points.

Returning to FIG. 4, the second leg segment 110 includes one or more apertures 114 extending therethrough and dimensioned to receive the fasteners 58 for coupling the vertical leg 102 to the stile 26. Similarly, the horizontal leg 110 also includes one or more apertures 116 extending therethrough for coupling the horizontal leg 104 to the bottom rail 30. The proximal leg 106 may include flanges 118 or other features designed to interact with and engage a corresponding key (not shown) of the balance shoe assembly (not shown) in the jambs 18, 20.

The pivot bar 100 may be made of any suitable material via any suitable manufacturing methods. For example, in one embodiment, the pivot bar 100 is made of zinc (or zinc alloys) and cast as a single, unitary structure. In some embodiments, the pivot bar 100 is made of a material with suitable strength properties to reinforce the corner joint 40 of the bottom sash 14.

FIG. 7 is an enlarged cross-section view along sectioning lines 7-7 (see FIG. 2) of the corner joint 40 illustrated the pivot bar 100 coupled to the sash frame 24, and FIG. 8 is a partially exploded view focusing on the corner joint 40 of the sash frame 24. With collective reference to FIGS. 7-8, when the pivot bar 100 is coupled to the sash frame 24, the second leg segment 110 of the vertical leg 102 sits within the channel 42 and is mounted flush against the bottom stile wall 48. Similarly, the horizontal leg 104 sits within the channel 50 and sits flush against the bottom rail wall 56, with the pivot bar 100 wrapping around the corner joint 40. Because the first and second leg segments 108, 110 are offset from one another, a pocket 120 is formed between the first leg segment 108 and the bottom stile wall 48 when the pivot bar 100 is coupled. The pocket 120 is in communication with an opening 122 formed on the bottom stile wall 48 of the stile 26 (see FIG. 3). That opening 122 in turn communicates with a port 124 of a corner key 126 adjoining the stile 26 and rail 30 together. The corner key 126 reinforces the corner of the sash frame 24 where the stile 26 and rail 30 meet. In some embodiments, a resin material, adhesive, foam, sealant, or other suitable material (not shown) is introduced into the corner key 126 and cured to provide further reinforcement. In such embodiments, any overflow of resin (or other) material flows through the port 124 of the corner key 126, through the opening 122 of the stile 26, and is captured in the pocket 120 between the pivot bar 100 and the stile 26 to minimize its spread.

As designed and discussed with reference to FIGS. 1-8, the pivot bar 100 mounts directly to exterior surfaces of the stiles 26, 28 and the bottom rail 30 of the sash frame 24, where the pivot bar 100 wraps around the corner joint 40 to provide added support and help secure the pivot bar 100 in position rather than relying primarily on the strength of the fasteners as in other designs. In addition, the ability to surface-mount the pivot bar 100 avoids the need for additional machining into the sash material, which leads to better structural integrity and overall performance of the sash frame 24 and window 10.

It will be obvious to those having skill in the art that many changes may be made to the details of the above-described embodiments without departing from the underlying principles of the invention. The scope of the present invention should, therefore, be determined only by the following claims.

The invention claimed is:

1. A tiltable window sash assembly comprising:

a first stile and an opposite second stile, the first stile including a first stile wall, a second stile wall, and a bottom stile wall extending between the first and second stile walls, the first stile further including a stile channel formed between the first and second stile walls;

a top rail and an opposite bottom rail, the top and bottom rails each extending horizontally across between the first and second stiles together forming a sash frame, the bottom rail further including a first rail wall, a second rail wall, and a bottom rail wall extending between the first and second rail walls, the bottom rail further including a rail channel formed between the first and second rail walls, wherein the stile channel and rail channel communicate with one another at a corner of the sash frame;

a pivot bar having a first leg and a second leg, the first leg positioned within the stile channel and coupled to the bottom stile wall, and the second leg positioned within the rail channel and coupled to the bottom rail wall such that the pivot bar wraps around the corner of the sash frame whereat the first stile and bottom rail meet, wherein the first leg of the pivot bar further includes a first leg segment extending along a first plane and a second leg segment extending along a second plane parallel to the first plane, and wherein the first leg segment and the bottom stile wall together enclose a pocket therebetween; and a corner key coupling the first stile and the bottom rail together at the corner of the sash frame, the corner key including a port in communication with the pocket enclosed by the first leg segment and the bottom stile wall.

2. The tiltable window sash assembly of claim 1, wherein the bottom stile wall further includes an opening in communication with the pocket and the port of the corner key, the opening directing overflow resin material from the corner key into the pocket.

3. The tiltable window sash assembly of claim 1, wherein the second leg segment further includes one or more openings for receiving fasteners therethrough, the pivot bar coupled to the bottom stile wall via the one or more openings of the second leg segment.

4. The tiltable window sash assembly of claim 1, the first leg further including a third leg segment extending between and connecting the first and second leg segments, and wherein the first leg segment connects with the second leg.

5. The tiltable window sash assembly of claim 1, wherein a first side edge of the first leg abuts the first stile wall and a second side edge of the first leg abuts the second stile wall, and wherein a first side edge of the second leg abuts the first rail wall and a second side edge of the second leg abuts the second rail wall.

6. The tiltable window sash assembly of claim 1, the pivot bar further including a third leg extending outwardly from the first stile, the third leg having one or more keying features designed to mate with a balance shoe assembly.

7. The tiltable window sash assembly of claim 1, wherein the stile channel extends along the entire length of the first stile between the top and bottom rails.

8. The tiltable window sash assembly of claim 1, wherein the rail channel extends along the entire length of the bottom rail between the first and second stiles, and wherein the second stile further includes a first stile wall, a second stile wall, and a bottom stile wall extending between the first and second stile walls, the second stile further including a second stile channel formed between the first and second stile walls, the second stile channel being in communication with the rail channel, the tiltable window sash assembly further including a second pivot bar having a first leg segment and a second leg segment, the first leg segment positioned within the second stile channel and coupled to the bottom stile wall, and the second leg segment positioned within the rail channel and coupled to the bottom rail wall.

9. A tiltable window sash assembly comprising:

a window frame;

an upper sash and a lower sash mounted within the window frame, the lower sash further comprising:

a first stile and an opposite second stile, the first stile including a first stile wall, a second stile wall, and a bottom stile wall extending between the first and second stile walls, the first stile further including a stile channel formed between the first and second stile walls;

a top rail and an opposite bottom rail, the top and bottom rails each extending horizontally across between the first and second stiles together forming a sash frame, the bottom rail further including a first rail wall, a second rail wall, and a bottom rail wall extending between the first and second rail walls, the bottom rail further including a rail channel formed between the first and second rail walls, wherein the stile channel and rail channel communicate with one another at a corner of the sash frame;

a pivot bar having a first leg segment and a second leg segment, the first leg segment positioned within the stile channel and coupled to the bottom stile wall, and the second leg segment positioned within the rail channel and coupled to the bottom rail wall such that the pivot bar wraps around the corner of the sash frame whereat the first stile and bottom rail meet, wherein the first leg of the pivot bar further includes a first leg segment extending along a first plane and a second leg segment extending along a second plane parallel to the first plane, and wherein the first leg segment and the bottom stile wall together enclose a pocket therebetween;

a latch mechanism coupled along the top rail, the latch mechanism actuatable to disengage the lower sash from the window frame, wherein the lower sash is pivotable relative to the window frame about the pivot bar when the latch mechanism is actuated; and further comprising a corner key coupling the first stile and the bottom rail together at the corner of the sash frame, the corner key including a port in communication with the pocket enclosed by the first leg segment and the bottom stile wall, wherein the bottom stile wall further includes an opening in communication with the pocket and the port of the corner key, the opening directing overflow resin material from the corner key into the pocket.

10. The tiltable window sash assembly of claim 9, wherein the stile channel extends along the entire length of the first stile between the top and bottom rails.

11. The tiltable window sash assembly of claim 9, wherein the rail channel extends along the entire length of the bottom rail between the first and second stiles, and wherein the second stile further includes a first stile wall, a second stile wall, and a bottom stile wall extending between the first and second stile walls, the second stile further including a second stile channel formed between the first and second stile walls, the second stile channel being in communication with the rail channel, the tiltable window sash assembly further including a second pivot bar having a first leg segment and a second leg segment, the first leg segment positioned within the second stile channel and coupled to the bottom stile wall, and the second leg segment positioned within the rail channel and coupled to the bottom rail wall.

12. A pivot bar for a tiltable window sash system having a sash with a stile and a rail that are joined at a corner by a corner key, the sash supported within a frame, the pivot bar comprising:

a first leg extending substantially along a first axis, the first leg having a first leg segment, a second leg segment, and a third leg segment that are arranged end-to-end substantially along the first axis, the first leg segment defining a first plane and the second leg segment defining a second plane that is parallel to the first plane, the third leg segment extending between the first leg segment and the second leg segment to separate the first leg segment and the second leg segment along the first axis;

a second leg extending from a lower portion of the first leg segment along a third plane, the second leg configured to mount to the rail, the third plane being generally orthogonal to each of the first and second planes; and a third leg extending from the lower portion of the first leg segment, the third leg arranged generally parallel to the third plane of the second leg, the third leg configured to pivotally attach the sash to the frame; and the second leg segment having a mounting face configured to mount against a surface of the stile with the first leg segment spaced apart from the surface of the stile to define a pocket therebetween.

13. The pivot bar of claim 12, further comprising one or more openings formed on the second leg segment of the first leg, the openings extending through the second leg segment and dimensioned for receiving a fastener therethrough.

14. The pivot bar of claim 12, further comprising one or more openings formed on the second leg, the openings extending through the second leg and dimensioned for receiving a second fastener therethrough.

15. The pivot bar of claim 12, wherein the first, second, and third legs are collectively formed as a single, unitary component.

16. The pivot bar of claim 15, wherein the pivot bar is cast using a zinc alloy material.

* * * * *